US008016662B1

(12) United States Patent
Hamman et al.

(10) Patent No.: US 8,016,662 B1
(45) Date of Patent: Sep. 13, 2011

(54) GAME-WINNER SELECTION BASED ON VERIFIABLE EVENT OUTCOMES

(75) Inventors: Robert D. Hamman, Dallas, TX (US); Kenneth R. Westerlage, Fort Worth, TX (US); William C. Kennedy, III, Dallas, TX (US)

(73) Assignee: SCA Promotions, Inc., Dallas, TX (US)

( * ) Notice: Subject to any disclaimer, the term of this patent is extended or adjusted under 35 U.S.C. 154(b) by 2129 days.

(21) Appl. No.: 10/303,097

(22) Filed: Nov. 22, 2002

(51) Int. Cl.
*A63F 9/24* (2006.01)

(52) U.S. Cl. ..... 463/22

(58) Field of Classification Search ..... 463/17, 463/22

See application file for complete search history.

(56) References Cited

U.S. PATENT DOCUMENTS

| | | | | | |
|---|---|---|---|---|---|
| 4,157,829 | A | | 6/1979 | Goldman et al. | 273/138 A |
| 4,527,798 | A | | 7/1985 | Siekierski et al. | 273/361 |
| 4,582,324 | A | * | 4/1986 | Koza et al. | 463/16 |
| 4,832,341 | A | | 5/1989 | Muller et al. | 273/139 |
| 5,042,809 | A | | 8/1991 | Richardson | 273/138 A |
| 5,112,050 | A | * | 5/1992 | Koza et al. | 463/17 |
| 5,282,620 | A | | 2/1994 | Keesee | 273/138 A |
| 5,286,023 | A | | 2/1994 | Wood | 273/138 A |
| 5,297,206 | A | * | 3/1994 | Orton | 380/30 |
| 5,330,185 | A | * | 7/1994 | Wells | 463/29 |
| 5,380,007 | A | | 1/1995 | Travis et al. | 273/138 A |
| 5,398,932 | A | | 3/1995 | Eberhardt et al. | 273/138 A |
| 5,456,465 | A | | 10/1995 | Durham | 273/138 A |
| 5,505,449 | A | | 4/1996 | Eberhardt et al. | 273/138 A |
| 5,507,489 | A | | 4/1996 | Reibel et al. | 273/138 A |
| 5,524,035 | A | | 6/1996 | Casal et al. | 377/47 |
| 5,551,692 | A | | 9/1996 | Pettit et al. | 273/143 R |
| 5,569,082 | A | | 10/1996 | Kaye | 463/17 |
| 5,674,128 | A | | 10/1997 | Holch et al. | 463/42 |
| 5,709,603 | A | | 1/1998 | Kaye | 463/17 |
| 5,797,794 | A | | 8/1998 | Angell | 463/18 |
| 5,800,269 | A | | 9/1998 | Holch et al. | 463/42 |
| 5,855,369 | A | | 1/1999 | Lieberman | 273/139 |
| 5,879,234 | A | | 3/1999 | Mengual | 463/20 |
| 5,938,200 | A | | 8/1999 | Markowicz et al. | 273/246 |
| 6,030,288 | A | | 2/2000 | Davis et al. | 463/29 |
| 6,033,308 | A | | 3/2000 | Orford et al. | 463/28 |
| 6,044,135 | A | | 3/2000 | Katz | 379/93.13 |
| 6,080,062 | A | | 6/2000 | Olson | 463/42 |
| 6,089,982 | A | | 7/2000 | Holch et al. | 463/42 |
| 6,099,408 | A | | 8/2000 | Schneier et al. | 463/29 |
| 6,146,272 | A | | 11/2000 | Walker et al. | 463/17 |
| 6,152,822 | A | * | 11/2000 | Herbert | 463/22 |
| 6,165,072 | A | | 12/2000 | Davis et al. | 463/29 |
| 6,168,521 | B1 | | 1/2001 | Luciano et al. | 463/18 |
| 6,183,361 | B1 | | 2/2001 | Cummings et al. | 463/18 |

(Continued)

OTHER PUBLICATIONS

Wikipedia, Numbers Game, http://en.wikipedia.org/wiki/Numbers_game.*

*Primary Examiner* — Corbett B Coburn
(74) *Attorney, Agent, or Firm* — Baker Botts L.L.P.

(57) ABSTRACT

A gaming system includes a game server and a client device. The game server accepts the publicly-verifiable outcome of a non-deterministic event as an input. The game server creates a seed from the outcome and inputs the seed into a random number generator to generate a random number. The game server generates a winner using the random number and communicates the winner to the client device.

24 Claims, 6 Drawing Sheets

U.S. PATENT DOCUMENTS

| | | | | |
|---|---|---|---|---|
| 6,254,480 | B1 * | 7/2001 | Zach | 463/17 |
| 6,264,557 | B1 | 7/2001 | Schneier et al. | 463/29 |
| 6,277,026 | B1 | 8/2001 | Archer | 463/42 |
| 6,280,328 | B1 | 8/2001 | Holch et al. | 463/42 |
| 6,296,569 | B1 * | 10/2001 | Congello, Jr. | 463/17 |
| 6,322,446 | B1 | 11/2001 | Yacenda | 463/16 |
| 6,325,716 | B1 * | 12/2001 | Walker et al. | 463/17 |
| 6,331,143 | B1 | 12/2001 | Yoseloff | 463/18 |
| 2001/0003098 | A1 | 6/2001 | Moody | 463/17 |
| 2001/0003100 | A1 | 6/2001 | Yacenda | 463/41 |
| 2001/0036853 | A1 | 11/2001 | Thomas | 463/17 |
| 2001/0046891 | A1 | 11/2001 | Acres | 463/18 |
| 2002/0002076 | A1 | 1/2002 | Schneier et al. | 463/29 |
| 2002/0006821 | A1 | 1/2002 | Park | 463/17 |
| 2002/0010015 | A1 | 1/2002 | Acres | 463/18 |
| 2002/0098883 | A1 * | 7/2002 | Packes et al. | 463/20 |
| 2003/0047557 | A1 * | 3/2003 | Chen | 219/552 |
| 2003/0060262 | A1 * | 3/2003 | Yeend | 463/17 |
| 2003/0074557 | A1 * | 4/2003 | Vatanen | 713/168 |

* cited by examiner

114

PARAMETER FILE
NUMBER OF WINNERS: 3
PRIZE LEVELS: 1. $10,000
2. $5,000
3. $1,000
RNG ALGORITHM: SECURE HASH ALGORITHM (SHA-1)

GAME-WINNER SELECTION BASED ON VERIFIABLE EVENT OUTCOMES

TECHNICAL FIELD OF THE INVENTION

The present invention relates to gaming systems. More particularly, the present invention relates to utilizing the outcome of a specified event to determine the winner of a game of chance.

BACKGROUND OF THE INVENTION

The gaming industry continues to grow in popularity with a wide variety of new games that offer different experiences to players. Games of chance create unique challenges for game designers and operators. Because games of chance depend in part on a random outcome to determine winners, there is a potential for fraud on the part of the game operator either in generating the random outcome or in using the outcome to determine a winner. If the validity of a selected winner is questionable, it can result in a diminished pool of players for future games or legal challenge of the current results.

Consequently, transparency has become a useful feature in the methods used to select game-winners. Game operators can refute challenges to a winner's validity by demonstrating that the outcome was solely a result of the parameters under which the game operated. However, a balance must be struck. In a game of chance, achieving transparency at the expense of randomness would be self-defeating. Therefore, a method is desired for selecting a winner that is both random and transparent.

SUMMARY OF THE INVENTION

In accordance with the present invention, the disadvantages and problems associated with operating a game of chance have been substantially reduced or eliminated. In particular, the invention provides a method and system for operating a game the results of which are both random and verifiable.

In accordance with one embodiment of the present invention, a method for determining a winner of a game of chance includes identifying an event prior to occurrence of the event, wherein the outcome of the event is non-deterministic and publicly-verifiable; determining a seed for a random number generator using the outcome of the event; generating one or more random numbers from the seed; and selecting at least one winner of the game using the random numbers.

In accordance with another embodiment of the present invention, a system for selecting the winner of a game includes a seed generator operable to generate a seed based on the outcome of an event, the event selected prior to occurrence of the event and the outcome of the event being publicly verifiable; a parameter list created prior to occurrence of the event; a player list created prior to occurrence of the event, the player list comprising a plurality of records, each record representing a player of the game; a random number generator operable to receive the seed and generate at least one random number; an evaluator operable to select a winner form the player list based on the parameter list and the random number.

Important technical advantages of certain embodiments of the present invention include the ability to generate a game-winner using the outcome of a non-deterministic event with the generation process being amenable to replication. This is desirable for purposes of validating the chosen winner.

Other important technical advantages of certain embodiments of the present invention include determining one or more winners where the winners are determined based on a non-deterministic outcome and one or more parameters, the parameters being defined prior to the game.

Additional technical advantages of the present invention will be readily apparent to one skilled in the art from the following figures, description, and claims. Moreover, while specific advantages have been enumerated above, various embodiments may include all, some, or none of the enumerated advantages.

BRIEF DESCRIPTION OF THE DRAWINGS

For a more complete understanding of the present invention and its advantages, reference is now made to the following description, taken in conjunction with the accompanying drawings, in which.

DETAILED DESCRIPTION OF THE INVENTION

Figure 1:
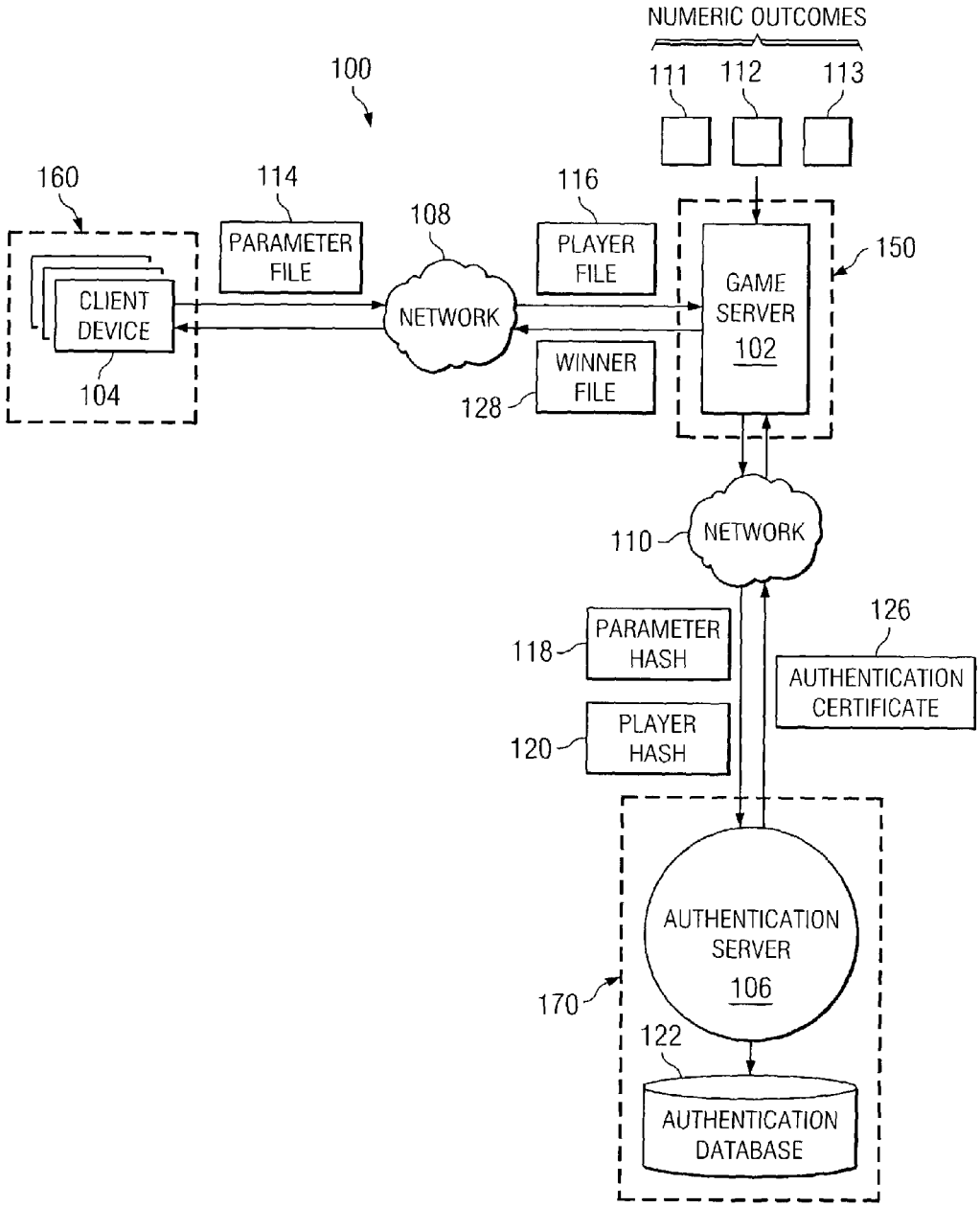
FIG. 1 illustrates a system according to one embodiment of the present invention that includes a game server, a client, and a trusted third party server.

FIG. 1 illustrates a gaming system 100 that includes a game server 102, a client device 104, and an authentication server 106. Client device 104 couples to game server 102 using a network 108, and game server 102 couples to authentication server 106 using a network 110. System 100 uses numeric outcomes 111, 112 and 113 from a non-deterministic event to determine a winner in a game of chance.

Networks 108 and 110 represent any hardware and/or software configured to communicate information in the form of packets, cells, frames, segments, or other portions of data. Networks 108 and 110 may include routers, hubs, switches, gateways, or any other suitable components in any suitable form or arrangement. Although network 108 and 110 may be physically and logically distinct, network 108 may refer to the same hardware and/or software as network 110. Networks 108 and 100 may comprise any combination of public or private communications equipment such as elements of a public switched telephone network (PSTN), a global computer network such as the Internet, a local area network (LAN), a wide area network (WAN), or other appropriate communications equipment Game server 102 is a general purpose computer, dedicated processor, or any other electronic device operable to communicate with client device 104 and process electronic information received from client device 104. Game operator 150 operates game server 102. Alternatively, game sponsor 160 may operate game server 102.

Client device 104 is a computer, browser, gaming device or any other electronic device capable of communicating electronic information to game server 102. Game sponsor 160 operates client device 104. Although FIG. 1 illustrates a particular embodiment that includes only one client device 104, gaming system 100 can include any number of client devices 104.

Authentication server 106 is a general purpose computer, dedicated processor, or any other electronic device operable to communicate with game server 102 and process electronic information received from game server 102. In a particular embodiment, trusted third party 170 operates authentication server 106.

Numerous entities may control or operate the elements of gaming system 100 and the entities may use a variety of different configurations to distribute the elements amongst them. In a particular embodiment, a game operator 150, a game sponsor 160, and a trusted third party 170 operate or control game server 102, client device 104, and authentication server 106 respectively.

In a particular embodiment, game sponsor 160 is a person, group of people, or entity responsible for disbursing prizes to winners of games conducted on gaming system 100. Game operator 150 is a person, group of people, or entity responsible for generating results for games conducted on gaming system 100. Trusted third party 170 is a person, group of people, or entity with no stake in the outcome of the game. Examples of trusted third party 170 include traditional public notaries, online digital notaries, or any other disinterested party capable of accurately recording a receipt time for information communicated to the party by game server 102. If game operator 150 holds no stake in the outcome of the game, game operator 150 may serve as trusted third party 170 and operate authentication server 106.

In gaming system 100, a game begins with game operator 150 and game sponsor 160 establishing parameters for the game including, but not limited to, the non-deterministic event that will provide the seed, the number of winners to be selected, and the prizes to be awarded. Parameters can include any information or data that will affect the selection of winners.

Game sponsor 160 generates a parameter file 114 containing these parameters. Game sponsor 160 also collects and records in a player file 116 information identifying all players playing the game. This may be done electronically, for example, through online-based Internet games. Alternatively, player file 116 can be populated manually, e.g. by typing in information from mailed-in entries.

Client device 104 communicates parameter file 114 and player file 116 to game server 102. Game server 102 generates parameter hash 118 and player hash 120 from parameter file 114 and player file 116 respectively. Game server 102 communicates parameter hash 118 and player hash 120 to authentication server 106.

Game server 102 creates parameter hash 118 and player hash 120 by applying a hashing function to parameter file 114 and player file 116. A hashing function can be any process by which the input value is transformed into a shorter, fixed-length output "hash" that uniquely represents the input value. For example, parameter hash 118, generated from parameter file 114 using a particular hashing function, will be unique. For the particular hashing function used, no file other than parameter file 114 will generate the same hash as parameter hash 118. Thus, a hashing function can be used to verify that the contents of a file have not changed by showing that an earlier-generated hash of the file is identical to a hash of the file in its current state.

Authentication server 106 stores parameter hash 118 and player hash 120 in authentication database 122. Authentication server 106 generates an authentication certificate 126 and communicates authentication certificate 126 to game server 102 via network 110. Authentication certificate 126 includes the time that authentication server 106 received parameter hash 118 and player hash 120. If the results of the game are challenged, game operator 150 can use authentication certificate 126 to prove that parameter hash 118 and player hash 120 were created before the non-deterministic event occurred.

Game server 102 accepts numeric outcomes 111, 112, and 113 and generates winner file 128 based on numeric outcomes 111, 112, and 113, parameter file 114 and player file 116. Game server 102 communicates winner file 128 to client device 104 via network 108. FIG. 1 illustrates a game server 102 accepting numeric outcomes 111, 112, and 113. Game server 102 may accept any number of suitable numeric outcomes.

Figures 2, 3A:
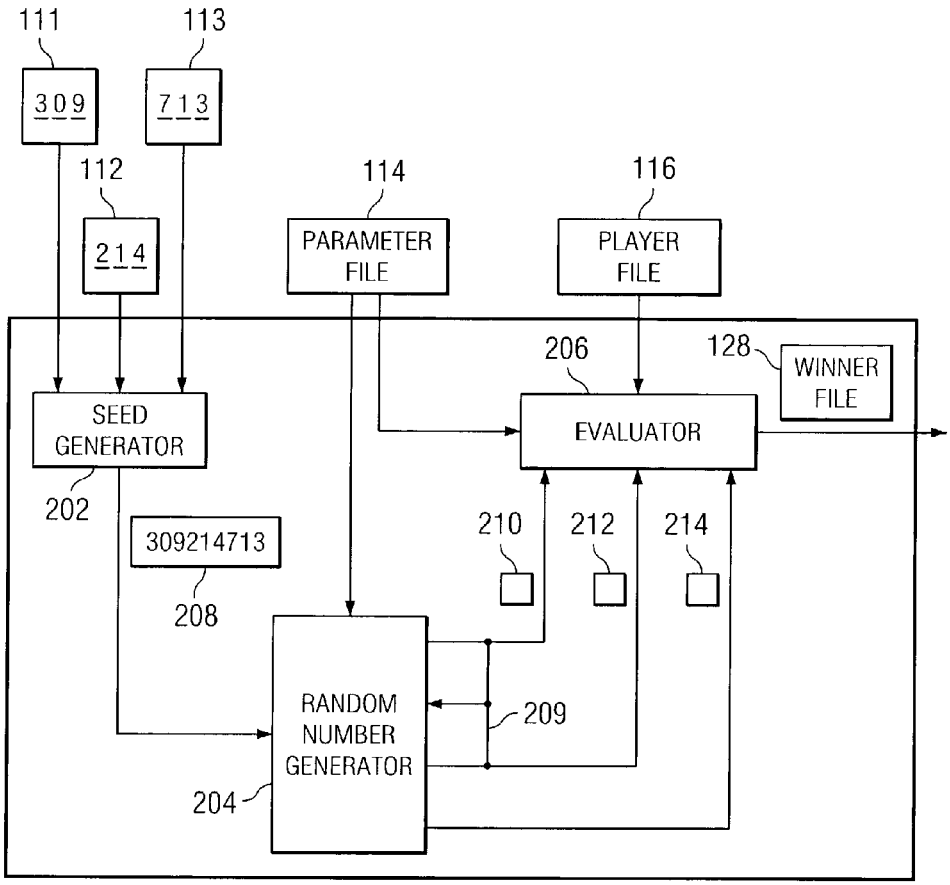
FIG. 2 is a block diagram illustrating exemplary components of the game server.
FIG. 3A illustrates an exemplary parameter file according to one embodiment of the present invention.

FIG. 2 provides further details of the composition and operation of game server 102. Game server 102 comprises a seed generator 202, a random number generator 204, and an evaluator 206. FIG. 2 illustrates the operation of game sever 102 in a game requiring three winners. Gaming system 100 can generate any number of winners for a particular game.

Seed generator 202 takes as inputs numeric outcomes 111, 112 and 113. FIG. 2 illustrates a seed generator 202 accepting a first numeric outcome 111, a second numeric outcome 112 and a third numeric outcome 113. However, seed generator 202 may accept any number of numeric outcomes in various embodiments of system 100.

Each of numeric outcomes 111, 112, and 113 is a number or series of numbers representing the outcome of a non-deterministic event. The event is selected prior to occurrence of the event and its result must be capable of public verification after occurrence of the event. Examples of such publicly-verifiable, numeric outcomes include, but are not limited to, the winning numbers of a specified state lottery, stock market prices at a specified time, the winning time of the Kentucky Derby, the officially-recorded high or low temperature for a specified city on a specified day, the total points scored in the Super Bowl, or any other non-deterministic event whose outcome can be expressed numerically and is publicly-verifiable after occurrence of the event. Publicly-verifiable outcomes include any that will be recorded in newspapers, public record, or any other permanent or archived source.

Seed generator 202 processes numeric outcomes 111, 112, and 113 and outputs seed 208. In FIG. 2, seed generator 202 concatenates numeric outcomes 111, 112, and 113 to create seed 208. Numeric outcomes 111, 112, and 113 may, individually or collectively, be shifted, transposed, normalized, or otherwise processed to fit the needs of random number generator 204.

Seed generator 202 communicates seed 208 to random number generator 204. Random number generator 204 also accepts parameter file 114 as an input. Parameter file 114 communicates to random number generator 204 game parameters such as the number of winners to be selected, the random number algorithm to be used, and the range of acceptable numeric outputs. Any or all of these parameters may be programmed into random number generator 204 prior to the game. Regardless of how random number generator 204 receives the game parameters, game server 102 fixes the game parameters prior to occurrence of the publicly verifiable event.

Random number generator 204 generates a random number 210 by inputting seed 208 into the specified random number algorithm. If multiple numbers are to be selected, the random number may be fed back into random number generator 204 to generate additional random numbers as indicated by feedback 209. In other embodiments, random number generator 204 may generate additional random numbers in a variety of ways and random number generator 204 may or may not include feedback 209. For example, random number generator 204 may use additional seeds to generate additional random numbers or may utilize a separate routine for generating additional random numbers. In FIG. 2, random number generator 204 generates first random number 210 from seed 208. Random number generator 204 uses first random number 210 as a seed and generates second random number 212. Random number generator 204 uses second random number 212 as a third seed and generates third random number 214.

Random number generator 204 communicates random numbers 210, 212, and 214 to evaluator 206. Evaluator 206 also accepts parameter file 114 and player file 116. Based on game parameters provided by parameter file 114, evaluator 206 uses random numbers 210, 212, and 214 to select three winners. Evaluator 206 maps numbers 210, 212, and 214 to entries in player file 116 to generate a winner file 128 indicating the selected winners and the prize level associated with each prize winner. Evaluator may use a variety of methods to map the numbers to player file 116. For example, evaluator 106 may read a number associated with each record of player file 116 and select the records associated with random numbers 210, 212, and 214. Alternatively, evaluator 106 may treat random numbers 210, 212, and 214 as index values to the winning records of player file 116. For example, if random number generator 204 generates random number 210 equal to "75", evaluator may select the "75th" record in player file 116. In various embodiments, evaluator 106 may use any suitable method of mapping random numbers 210, 212, and 214 on to player file 116 to selected winners. Once winner file 116 has been generated, evaluator 206 communicates winner file to client device 104.

FIG. 3A illustrates further details of the contents of parameter file 114. Parameter file 114 contains information that affects the selection of winners by game server 102. Parameter file 114 can be an electronic file, a paper list, or any other distinct, transferable collection of information. As shown in FIG. 3, such information can include the rules of the game being conducted, the number of winners to be selected, the number of prize levels, and the algorithm to be used in generating random numbers. Additionally, where the game operator is concurrently conducting multiple games, parameter file 114 may contain information identifying the particular game and client device 104 with which that parameter file is associated. Parameter file 114 may contain any or all of these items of information as dictated by the characteristics of the particular game server 102 employed and of the game being conducted. Game operator 150 and game sponsor 160 agree to the contents of parameter file 114 prior to the start of the game.

Figure 3B:
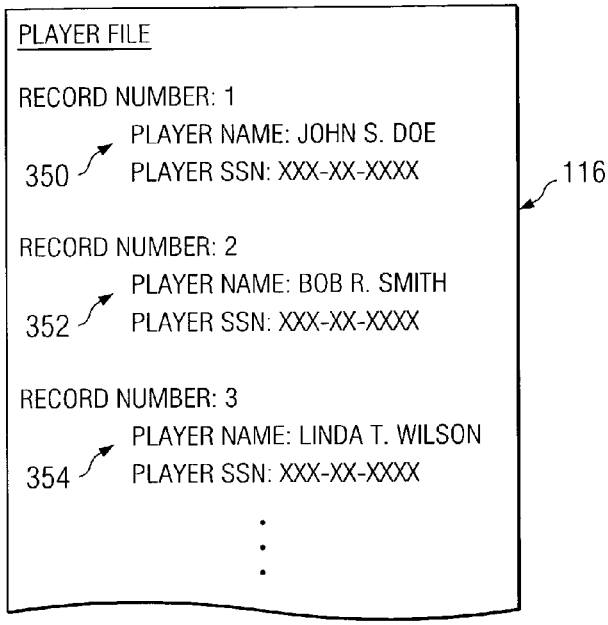
FIG. 3B illustrates an exemplary player file according to one embodiment of the present invention.

FIG. 3B illustrates further details of the contents of one embodiment of player file 116. Player file 116 contains a plurality of records 350, 352, and 354, each record representing a player or entry in the game. Player file 116 can be an electronic file, a paper list, or any other distinct, transferable collection of information. Game sponsor 160 may generate player file 116 in a number of ways, depending on the characteristics of the game being conducted and the players involved. For example, for a game operated on the Internet, game sponsor 160 may collect entries, process entries and generate player file 116 all electronically through browser-based submissions from players. Alternatively, for a game conducted through the mail, game sponsor 160 may extract information from mailed-in entries and generate player file 116 by manually entering the information into client device 104.

Regardless of how player file 116 is generated, each record 350, 352, 354 of player file 116 contains sufficient information for client device 104 to associate a specific player with a corresponding record 350, based on additional information maintained by client device 104. The records of player file 116 may include only a player number or other identifying information that is later mapped onto a list of players by client device 102.

As illustrated by FIG. 3B, player file 116 may alternatively include information sufficient to associate the record with a particular winning individual solely on the basis of information contained in the record. For example, the record can include the full name and/or social security number of the individual associated with that record. The inclusion of this information in a player file 116 can be useful to eliminate allegations of fraud in the mapping process from random numbers 210, 212, and 214 to winners.

Figure 3C:
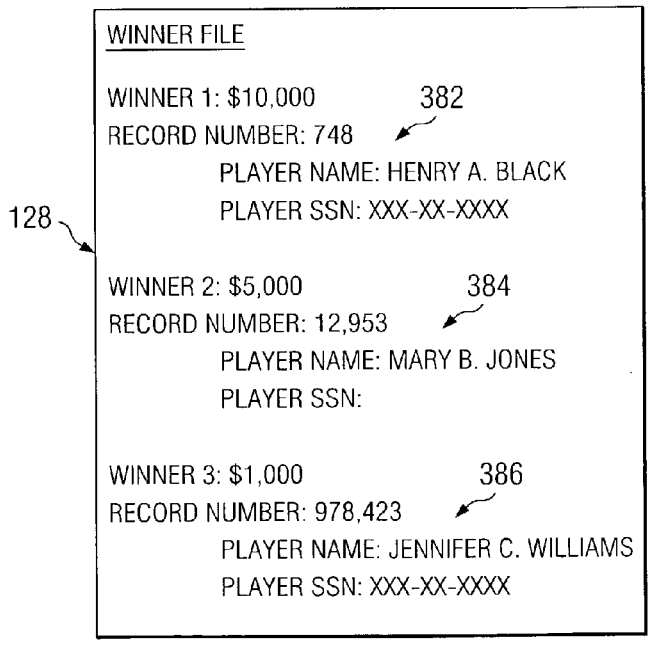
FIG. 3C illustrates an exemplary winner file according to one embodiment of the present invention.

FIG. 3C illustrates further details of the contents of winner file 128 under one embodiment of the present invention. Winner file 128 contains information identifying, directly or indirectly, the one or more winners selected by game server 102 and where appropriate the prize level associated with each winner. Winner file 128 can be an electronic file, a paper list, or any other transferable collection of information. As illustrated by FIG. 3C, in one embodiment of the present invention, winner file 128 includes the full records 382, 384, and 386 of the winners and the prize awarded to each.

Figure 4:
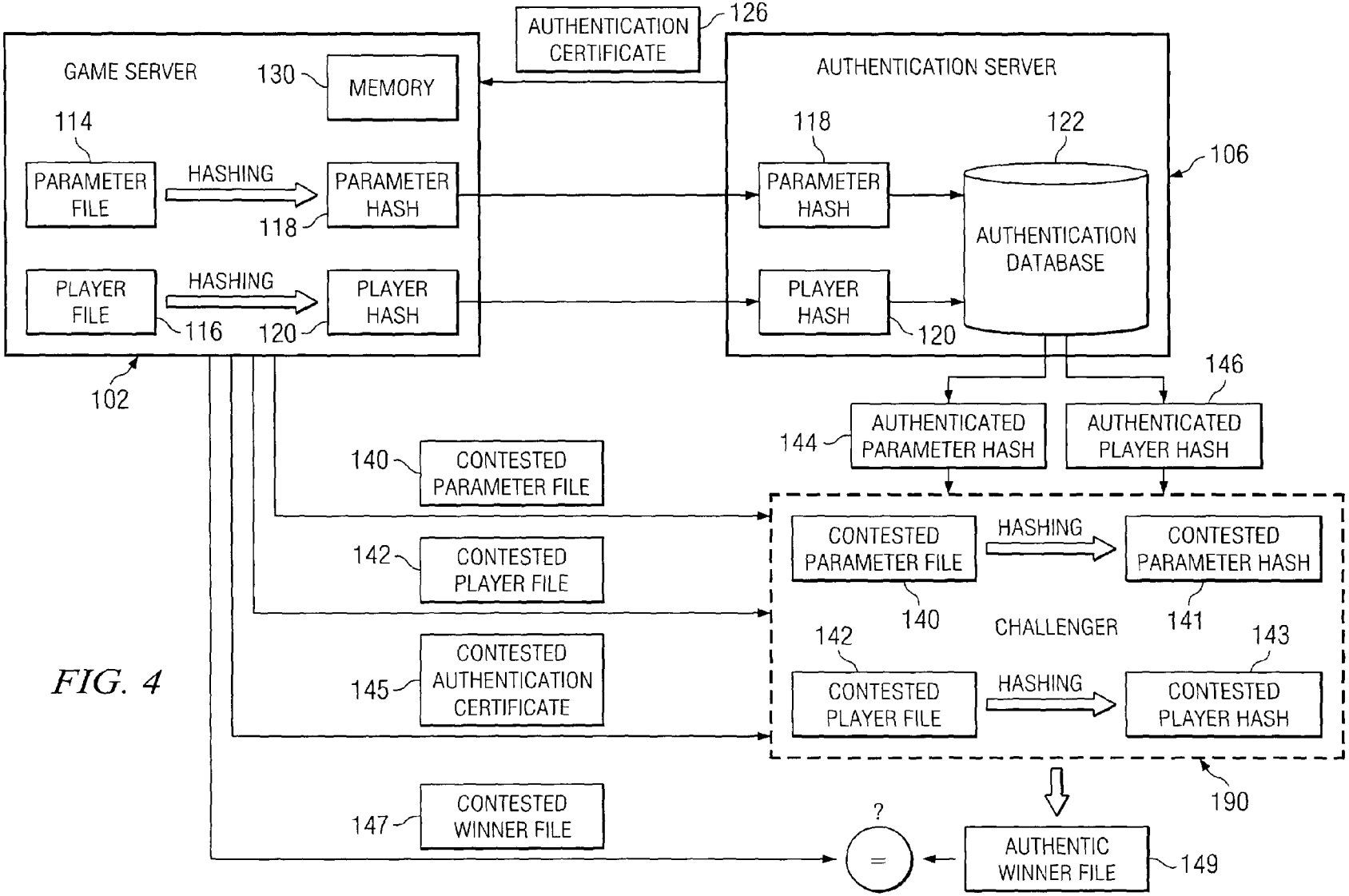
FIG. 4 is a block diagram illustrating operation of an authentication server according to one embodiment of the present invention.

FIG. 4 illustrates the operation of authentication server 106 when game system 100 conducts a game. Authentication server 106 is operated by a trusted third party 170. Game server 102 computes a hash of parameter file 114, parameter hash 118, and a hash of player file 116, player hash 120. Game server 102 communicates parameter hash 118 and player hash 120 to authentication server 106.

Authentication server 106 generates authentication certificate 126 which is digitally signed and indicates the time that game server 102 received parameter hash 118 and player hash 120. The time indicated on authentication certificate 126 may be any combination of time or date information. Authentication server 106 stores parameter hash 118 and player hash 120 in authentication database 122. Authentication server 106 then communicates authentication certificate 126 to game server 102.

Game server 102 stores authentication certificate 126 in memory 130 in case authentication of game results is needed. Memory 130 can comprise any collection and arrangement of volatile or non-volatile, local or remote devices suitable for storing data, for example, random access memory (RAM) devices, read only memory (ROM) devices, magnetic storage devices, optical storage devices, or any other suitable data storage devices.

FIG. 4 also shows the operation of authentication server 106 during verification of a challenged game. To challenge a game, a challenger 190 indicates to game sponsor 160 or game operator 150 a desire to verify the validity of a game's winners. Game server 102 communicates to challenger 190 a copy of the parameter file 114 used in the challenged game, contested parameter file 140; and a copy of the player file 116 used in the challenged game, contested player file 142. Game server 102 also communicates to challenger 190 a copy of the authentication certificate associated with the challenged game, contested authentication certificate 145, and a copy of the winner file associated with the challenged game, contested winner file 147.

Additionally, game server 102 may provide challenger 190 a copy of the hash function associated with the challenged game or may inform challenger 190 of a publicly-available hash function that was used to generate the original parameter hash 118 and player hash 120. Challenger 190 then generates contested parameter hash 141 and contested player hash 143 from contested parameter file 140 and contested player file 142, respectively.

Challenger 190 requests a copy of the parameter hash and player hash stored by authentication server 106 when the game was conducted, authenticated parameter hash 144 and authenticated player hash 146. Authentication server 106 retrieves authenticated parameter hash 144 and authenticated player hash 146 from authentication database 122 and communicates authenticated parameter hash 144 and authenticated player hash 146 to challenger 190.

Challenger 190 compares contested parameter hash 141 to authenticated parameter hash 144 and contested player hash 143 to authenticated player hash 146. If contested parameter hash 141 and contested player hash 143 are identical to authenticated parameter hash 144 and authenticated player hash 146 respectively and the time on contested authentication certificate 145 is before the time of the designated seed event in contested parameter file 140, then challenger knows that contested parameter file 140 and contested player hash 142 have been unchanged since being sent to authentication server 106. More importantly, challenger 190 knows that neither game sponsor 160 nor game operator 150 altered contested parameter file 140 or contested player file 142 after the seed event occurred to obtain fraudulent results.

Alternatively, the comparison may be done by trusted third party 170. In a particular embodiment, challenger 190 generates contested parameter hash 141 and contested parameter hash 143. Challenger 190 indicates to trusted third party 170 the game challenger 190 is challenging and communicates contested parameter hash 141 and contested parameter hash 143 to trusted third party 170. Trusted third party 170 compares contested parameter hash 141 and contested parameter hash 143 with the authenticated parameter hash 144 and authenticated parameter hash 146, respectively, that are associated with the designated game in authentication database 122. Trusted third party 170 will then indicate to challenger 190 whether contested parameter hash 141 and contested parameter hash 143 are identical to authenticated parameter hash 144 and authenticated parameter hash 146, respectively.

Following authentication of contested parameter file 140 and contested parameter file 142, challenger 190 generates a list of winners, authenticated winner file 149. To do this, challenger 190 uses the outcome of the seed event, random number generator 204, and other parameters included in contested parameter file 140 to select a winner from contested player file 142. If authenticated winner file 149 generated by challenger 190 matches contested winner file 147, then the results of the contested game have been verified.

Figure 5:
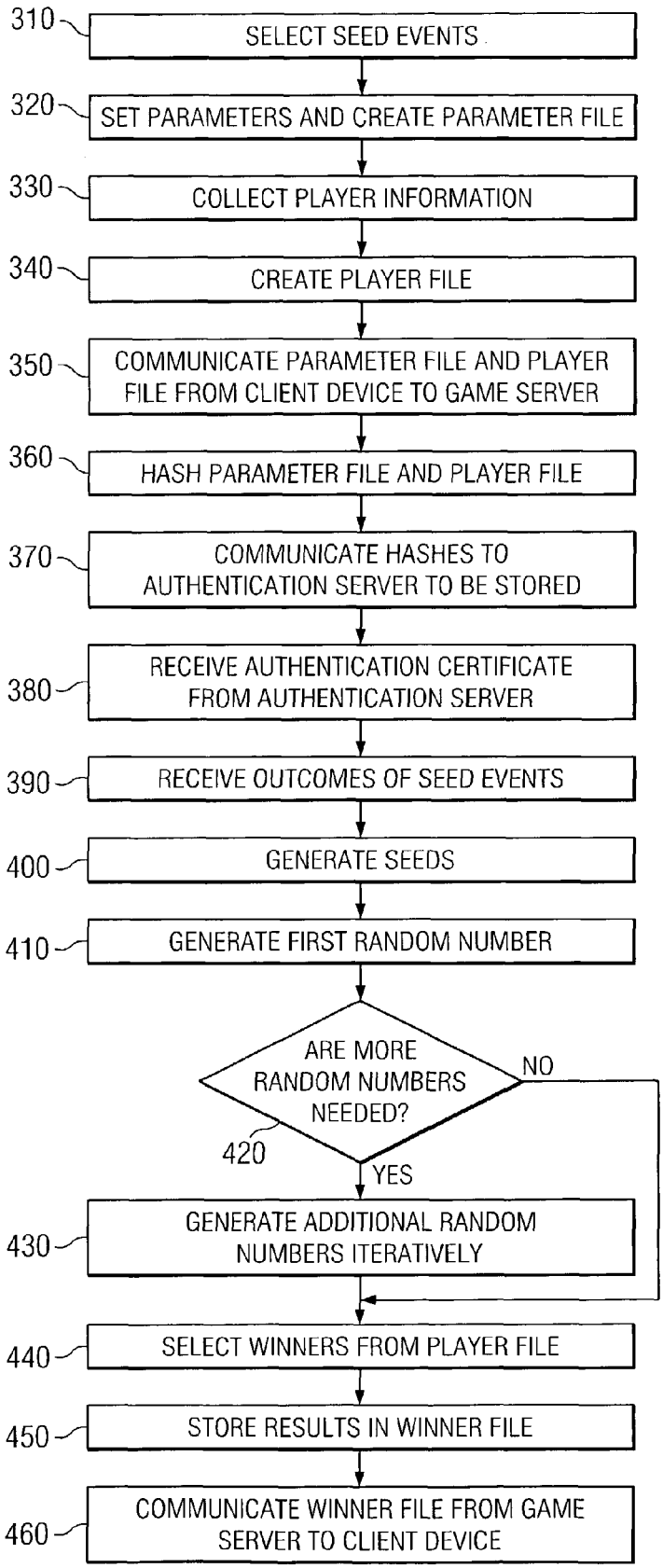
FIG. 5 is a flow chart illustrating operation of a game from the perspective of both a game sponsor and a game client according to one embodiment of the present invention.

FIG. 5 is a flow chart illustrating the operation of one embodiment of gaming system 100. Game sponsor 160 and game operator 150 select non-deterministic events with publicly-verifiable, numeric outcomes 111, 112, and 113 as seed events at step 310. Game sponsor 160 and game operator 150 set parameters for the game at step 320 and store parameters in a parameter file 114 including information identifying the seed events, the random number algorithm, the number of prize winners to be selected and the level of prizes to be awarded. Client device 104 collects information regarding game players at step 330. Client device 104 creates player file 116 which includes records representing game players or game entries into a player file 116 at step 340. Client device communicates parameter file 114 and player file 116 to game server 102 at step 350.

Game server 102 converts parameter file 114 and player file 116 into parameter hash 118 and player hash 120 respectively at step 360. At step 370, game server 102 communicates parameter hash 118 and player hash 120 to authentication server 106 to be stored in authentication database 122. At step 380, game server 102 receives from authentication server 106 an authentication certificate 126 indicating the time that authentication server 106 received parameter hash 118 and player hash 120. Game server 102 stores authentication certificate 126.

At step 390, the seed event occurs and game server 102 receives numeric outcomes 111, 112, and 113. Seed generator 202 processes numeric outcomes 111, 112, and 113 to generate seed 208 and communicates seed 208 to random number generator 204 at step 400. Random number generator 204 generates first random number 210 at step 410. Using parameter file 114, random number generator 204 determines whether additional random numbers are needed at step 420. If so, random number generator 204 iteratively generates additional random numbers, e.g. second random number 212 and third random number 214, by using generated first random number 210 and successive generated numbers as inputs at step 430.

After all needed random numbers are generated, evaluator 206 uses random numbers 210, 212, and 214 to select winners from the player file 116 based on the contents of the parameter file 114 in step 440. Evaluator 206 selects the indicated number of winners for each of the desired prize levels. Evaluator 206 stores the results in a winner file at step 450. Game server 102 communicates the winner file 128 to client device 104 in step 460.

Figure 6:
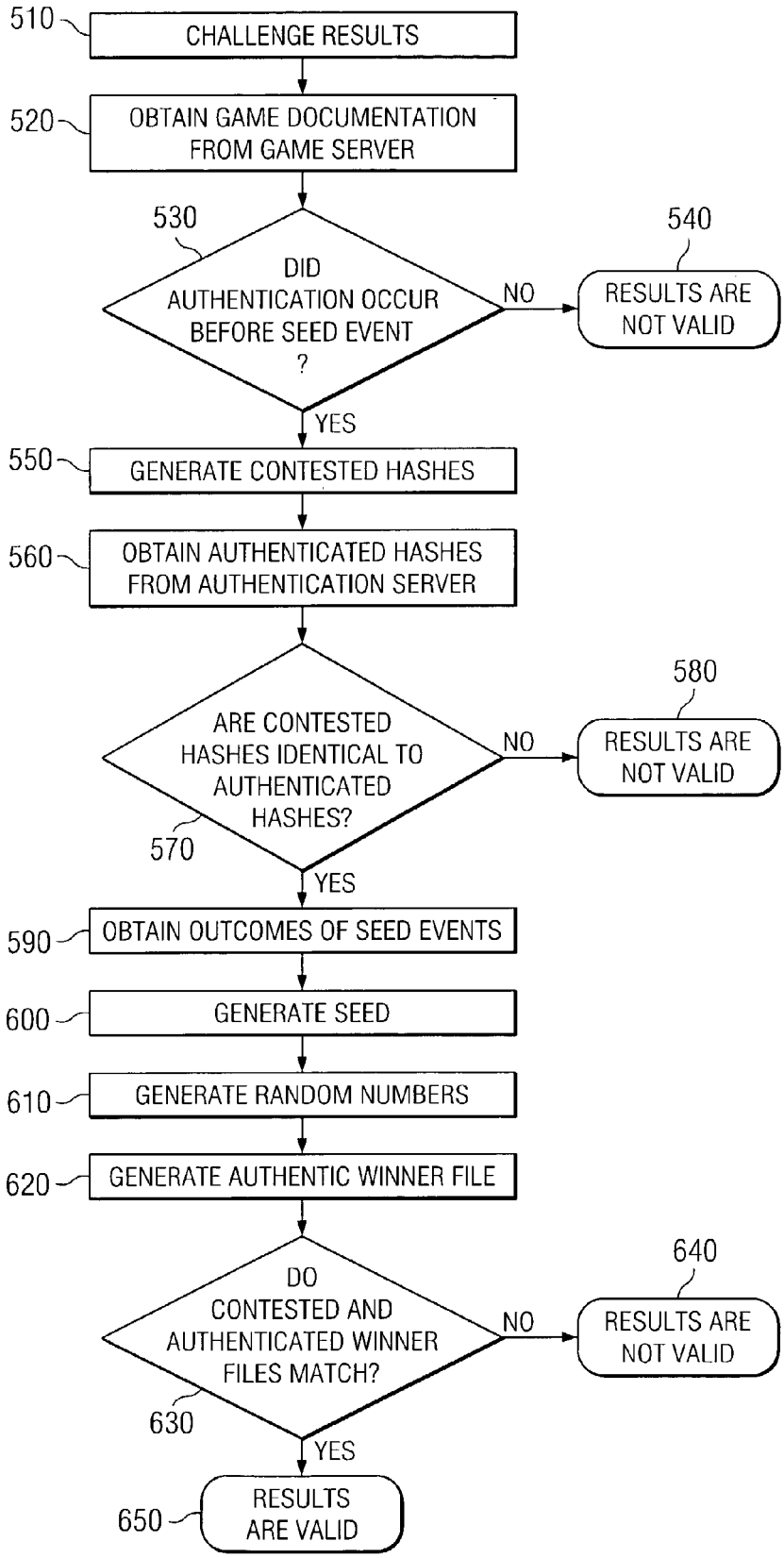
FIG. 6 is a flow chart illustrating an authentication process according to one embodiment of the present invention.

FIG. 6 is a flow chart showing authentication of the results of a game conducted according to one embodiment of the present invention. Challenger 190 indicates a desire to challenge the results of the game at step 510. Challenger 190 obtains from game server 102 game documentation associated with the challenged game at step 520. This includes contested parameter file 140, contested player file 142, contested winner file 145 and contested authentication certificate 147.

Challenger 190 verifies at step 530 whether the receipt time indicated in authentication certificate 126 precede occurrence of the seed event identified in parameter file 114. If not, results are not valid at step 540. If authentication preceded the seed event, challenger 190 converts parameter file 114 and player file 116 into parameter hash 118 and player hash 120 respectively at step 550.

At step 560, challenger 190 obtains authenticated parameter hash 144 and authenticated player hash 146 from authentication server 106. At step 570, challenger 190 compares contested parameter hash 141 with authenticated parameter hash 144 and contested player hash 143 with authenticated player hash 146 to determine whether contested parameter hash 141 and contested player hash 143 are identical to the authenticated parameter hash 144 and authenticated player hash 146, respectively. If not, parameter file 114 or player file 116 has been altered and the game results are not valid as shown at step 580.

If contested parameter hash 141 and contested player hash 143 are identical to authenticated parameter hash 144 and authenticated player hash 146, respectively, challenger 190 obtains numeric outcomes 111, 112, and 113 of the seed events at step 590. Challenger 190 uses the formatting procedure indicated in contested parameter file 140 to create seed

208 from numeric outcomes 111, 112, and 113 at step 600. Challenger 190 generates random numbers 210, 212, and 214 using the specified random number generator 204 at step 610. Challenger 190 maps random numbers 210, 212, and 214 onto contested player file 116 to generate authenticated winner file 149 at step 620. At step 630, challenger 190 compares the authenticated winner file 149 to the contested winner file 145 to verify the original results were authentic. Authentication results are shown at step 640 and 650.

Although the present invention has been described with several embodiments, a myriad of changes, variations, alterations, transformations, and modifications may be suggested to one skilled in the art, and it is intended that the present invention encompass such changes, variations, alterations, transformations, and modifications as fall within the scope of the appended claims.

What is claimed is:

1. A method for determining a winner of a game of chance, comprising:

identifying a plurality of events prior to occurrence of the events, wherein the outcomes of the plurality of events are publicly-verifiable;

defining one or more parameters for a game prior to occurrence of the plurality of events;

determining a seed for a random number generator using the outcomes of the plurality of events;

generating at least one random number using the seed; and selecting at least one winner of the game using the random number and the parameters.

2. The method of claim 1, wherein the parameters identify a number of prize levels to be awarded and a number of winners for each prize level, and the method further comprises generating an ordered list of a plurality of winners.

3. The method of claim 1, wherein the parameters identify an algorithm for determining the seed from the outcomes of the plurality of events and an algorithm for generating the random number from the seed.

4. The method of claim 1, wherein the parameters identify the plurality of events.

5. The method of claim 1, wherein defining parameters comprises:

generating a parameter file containing the parameters;

signing the parameter file digitally;

communicating the parameter file to a trusted third party; and receiving a certificate from the trusted third party indicating the time at which the trusted third party received the parameter file.

6. The method of claim 1, wherein at least one random number comprises a first random number and a second random number, and wherein generating at least one random number comprises:

generating the first random number using the seed; and generating the second random number using the first random number.

7. The method of claim 1, wherein selecting at least one winner comprises choosing a winner from a list of players determined prior to occurrence of the plurality of events.

8. The method of claim 1, further comprising:

generating a player file, the player file comprising records identifying players of the game;

signing the player file digitally;

communicating the player file to a trusted third party; and receiving a certificate from the trusted third party indicating the time at which the trusted third party received the player file.

9. The method of claim 1, wherein the events are public lotteries.

10. The method of claim 1, wherein:

generating at least one random number comprises generating a plurality of random numbers using the outcomes of the plurality of events; and selecting at least one winner comprises selecting at least one winner of the game using the plurality of random numbers and the parameters.

11. A method for running a game, comprising:

selecting a plurality of events prior to occurrence of the events, wherein the outcomes of the plurality of events are publicly verifiable;

receiving a parameter file prior to occurrence of the selected plurality of events, the parameter file containing one or more game parameters for a game;

recording the parameter file prior to occurrence of the selected plurality of events;

receiving a player file prior to occurrence of the selected plurality of events, the player file comprising a plurality of records, each record representing a player of the game;

recording the player file prior to occurrence of the selected plurality of events;

receiving the outcomes of the plurality of events;

creating a seed for a random number generator using the outcomes of the plurality of events;

generating at least one random number from the seed;

selecting at least one winner from the player file based on the random number and the game parameters recorded in the parameter file;

generating a winner file identifying a winner of the game; and communicating the winner file to a game sponsor.

12. The method of claim 11, wherein the player file comprises a plurality of records, each record including unique personal information sufficient to independently identify the player represented by the record.

13. The method of claim 11, wherein selecting at least one winner comprises reading a plurality of prize levels from the parameter file, and wherein generating a winner file comprises generating a list identifying winners and corresponding prize levels associated with the winners.

14. The method of claim 11, wherein the parameters comprise information identifying the selected plurality of events.

15. The method of claim 11, wherein the parameters comprise:

an algorithm to calculate the seed; and an algorithm to generate the random number.

16. The method of claim 11, wherein the events are public lotteries.

17. The method of claim 11, further comprising:

signing the parameter file and the player file with a digital signature;

communicating the parameter file and the player file to a trusted third party;

receiving a digital certificate from the trusted third party indicating the time at which the trusted third party received the parameter file and the player file; and storing the digital certificate.

18. A system for selecting the winner of a game, comprising:

a seed generator operable to generate a seed based on the outcomes of a plurality of events, wherein the plurality of events are selected prior to occurrence of the plurality of events and wherein the outcomes of the plurality of events are publicly verifiable;

a parameter file created prior to occurrence of the plurality of events;

a player file created prior to occurrence of the plurality of events, the player file comprising a plurality of records, each record representing a player of a game;

a random number generator operable to receive the seed and generate one or more random numbers; and an evaluator operable to select a winner from the player file using the parameter file and the random numbers.

19. The system of claim 18, wherein each record of the player file includes information sufficient to uniquely identify the player represented by the record.

20. The system of claim 18, wherein the parameter file comprises information defining a plurality of prize levels to be awarded.

21. The system of claim 18, wherein the parameter file comprises information identifying the plurality of events.

22. The system of claim 18, wherein the parameter file comprises an algorithm for generating the seed and an algorithm for generating the random number.

23. The system of claim 18, further comprising:

a hash generator operable to generate a parameter hash from the parameter file and a player hash from the player file;

an interface operable to communicate the parameter hash and the player hash to an authentication server and operable to receive an authentication certificate from the authentication server indicating the time at which the authentication server received the parameter hash and the player hash; and a memory operable to store the authentication certificate.

24. The system of claim 18, wherein the events are public lotteries.

* * * * *